US011730275B2

(12) United States Patent
Ermalovich et al.

(10) Patent No.: US 11,730,275 B2
(45) Date of Patent: Aug. 22, 2023

(54) COVERS FOR ADJUSTABLE LENGTH BED LEGS

(71) Applicant: Ergomotion, Inc., Goleta, CA (US)

(72) Inventors: Joseph Ermalovich, Santa Barbara, CA (US); Carli Hill, Oxnard, CA (US)

(73) Assignee: Ergomotion, Inc., Goleta, CA (US)

( * ) Notice: Subject to any disclaimer, the term of this patent is extended or adjusted under 35 U.S.C. 154(b) by 0 days.

(21) Appl. No.: 17/408,750

(22) Filed: Aug. 23, 2021

(65) Prior Publication Data

US 2022/0061540 A1 Mar. 3, 2022

Related U.S. Application Data

(60) Provisional application No. 63/069,847, filed on Aug. 25, 2020.

(51) Int. Cl.
*A47C 19/02* (2006.01)
*A47C 19/00* (2006.01)

(52) U.S. Cl.
CPC ..... *A47C 19/024* (2013.01); *A47C 19/005* (2013.01)

(58) Field of Classification Search
CPC ..... A47C 19/024; A47B 91/00; A47B 95/043; A47B 57/10; A47B 57/136; A47B 57/26; A47B 57/265; A47B 2009/185; A47B 9/18; A47B 2013/022; A47B 91/02; A47B 91/12; A47B 96/201; A47B 2200/002; A47B 2200/0022; Y10T 16/209; Y10T 16/21

See application file for complete search history.

(56) References Cited

U.S. PATENT DOCUMENTS

| | | | | |
|---|---|---|---|---|
| 713,794 | A | 11/1902 | Ostermann | |
| 2,222,842 | A | 11/1940 | Humphrey | |
| 3,472,489 | A * | 10/1969 | Baylin | E04F 11/1842 256/22 |
| 3,741,251 | A | 6/1973 | Rees | |
| 5,127,342 | A | 7/1992 | Taylor | |
| 5,603,140 | A * | 2/1997 | Pryce | A47B 91/00 16/42 R |
| 5,873,144 | A * | 2/1999 | Tupper | B60B 7/08 16/18 CG |
| 6,629,506 | B2 * | 10/2003 | Park | A47B 91/024 248/188 |
| 6,854,697 | B2 | 2/2005 | Akaike | |
| 7,182,993 | B1 * | 2/2007 | Hamilton | A63H 33/006 428/122 |

(Continued)

FOREIGN PATENT DOCUMENTS

| | | | | |
|---|---|---|---|---|
| DE | 102006049338 A1 | 4/2008 | | |
| DK | 201600057 U4 * | 9/2017 | | A47B 91/12 |
| JP | H0638721 U * | 5/1994 | | A47C 19/024 |

*Primary Examiner* — David R Hare
*Assistant Examiner* — Alison N Labarge
(74) *Attorney, Agent, or Firm* — Bodman PLC

(57) ABSTRACT

A leg cover for a bed leg having a plurality of leg segments incorporates a plurality of cover segments each having matching length with a length of a corresponding leg segment. Each cover segment has a longitudinal separation, an upper circumferential separation and a lower circumferential separation. The leg cover is adapted to be separated at the circumferential separations to match a reduced length of the segmented leg if one or more leg segments is removed.

20 Claims, 15 Drawing Sheets

(56) References Cited

U.S. PATENT DOCUMENTS

| | | | | |
|---|---|---|---|---|
| 7,770,861 | B2 * | 8/2010 | Huxtable | E01F 15/141 248/345.1 |
| 8,584,598 | B2 * | 11/2013 | Derkoski | A47B 3/12 108/14 |
| 10,939,676 | B1 * | 3/2021 | Harter | E04G 5/10 |
| 2003/0131767 | A1 * | 7/2003 | Chen | A47B 57/265 108/147.13 |
| 2010/0300028 | A1 * | 12/2010 | Huxtable | E04F 13/0733 52/562 |
| 2012/0061545 | A1 * | 3/2012 | Schneider | A47B 95/043 248/345.1 |
| 2013/0322956 | A1 | 12/2013 | Montalto et al. | |
| 2015/0210473 | A1 * | 7/2015 | Sharratt | B08B 1/006 264/263 |
| 2016/0007759 | A1 * | 1/2016 | Polevoy | A47C 19/005 5/400 |
| 2019/0150611 | A1 * | 5/2019 | Burnett | A47B 7/00 |
| 2019/0343277 | A1 * | 11/2019 | Sabounjian | A47B 47/0083 |

* cited by examiner

COVERS FOR ADJUSTABLE LENGTH BED LEGS

REFERENCES TO RELATED APPLICATIONS

This application claims the priority of U.S. Provisional Application Ser. No. 63/069,847 filed on Aug. 25, 2020 entitled COVERS FOR ADJUSTABLE LENGTH BED LEGS having a common assignee with the present application, the disclosure of which is incorporated herein by reference.

BACKGROUND

Field

This invention relates generally to the field of bed frames and more particularly to removable and length adjustable covers for bed legs with adjustable length.

Description of the Related Art

Modern bedroom furniture is typically modular with features that are adjustable for size or comfort. Bed frames, in particular, are often constructed to be assembled in a base size with adjustment or interconnection for larger sizes. For example, a frame configured for a twin sized mattress may be joined with a second identical frame to create a king size bed platform. Legs to support the bed frame are typically removable to allow package size reduction for shipment. Additionally, removable legs may be offered with different lengths to accommodate desired bed heights. In certain applications, rather than manufacturing multiple differing leg lengths, individual legs may be "stackable" having multiple engaging segments to form a series of lengths.

It is also desirable to have differing color or patterning on bed legs for matching other furniture or room decor. Removable, or conversely "assembleable", covers may be employed to allow manufacturing of legs in a single color or finish and then altering in appearance with chosen separate covers.

It is therefore desirable to provide leg covers which may be employed with segmented leg sections.

SUMMARY

The implementations disclosed herein provide a leg cover for a bed leg having a plurality of leg segments. The cover is concentrically received over the bed leg and incorporates a plurality of cover segments each having matching length with a length of a corresponding leg segment. Each cover segment has a longitudinal separation, an upper circumferential separation and a lower circumferential separation. The leg cover is adapted to be separated at the circumferential separations to match a reduced length of the segmented leg if one or more leg segments is removed.

BRIEF DESCRIPTION OF THE DRAWINGS

These and other features and advantages of the present invention will be better understood by reference to the following detailed description of exemplary embodiments when considered in connection with the accompanying drawings wherein.

DETAILED DESCRIPTION

Figure 1:
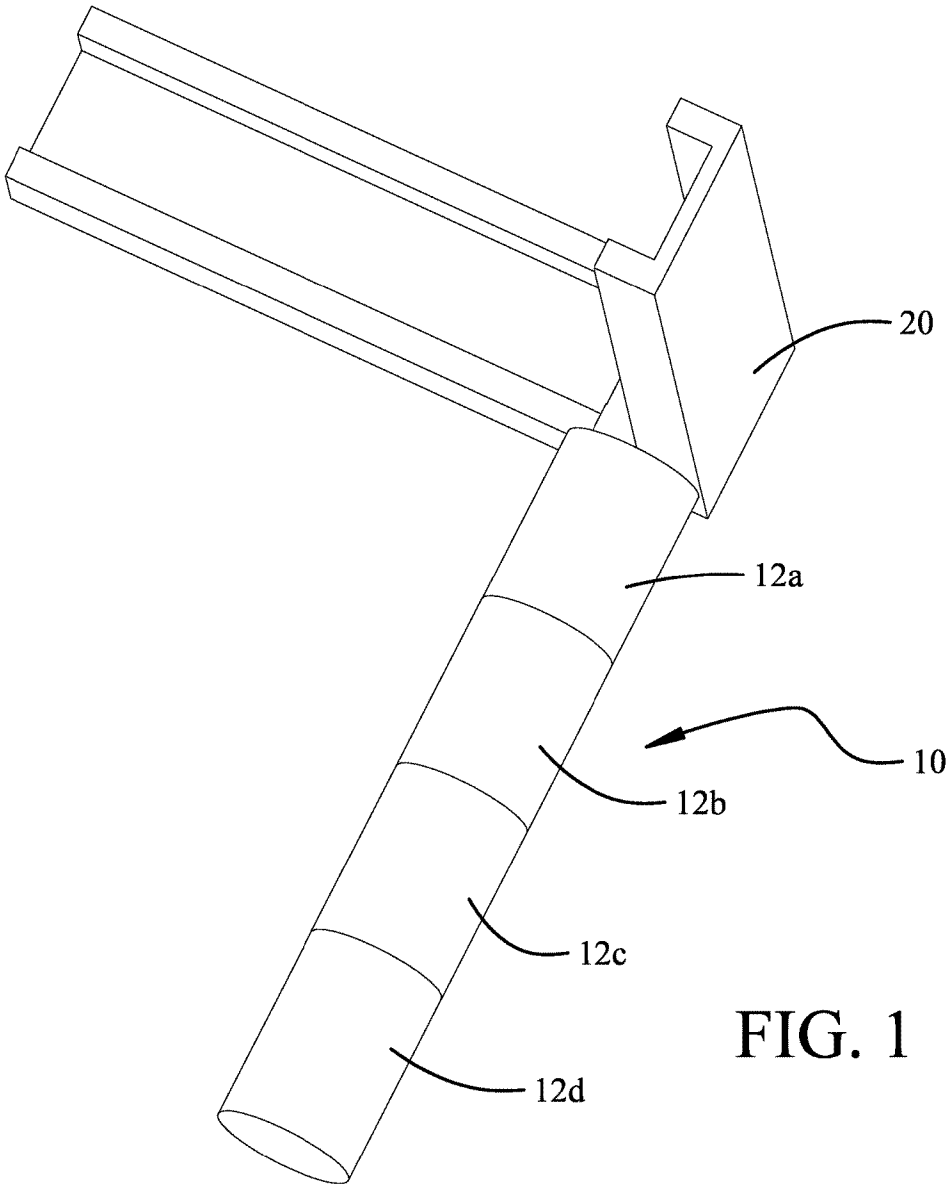
FIG. 1 is a pictorial depiction of an example segmented leg with a partial bedframe corner.

Implementations shown in the drawings and described herein provide segmented covers for attachment to segmented bed frame legs for altered aesthetic appearance. While described herein as applicable to legs for bed frames, the implementations may also be applicable to other furniture leg applications.

Figure 2:
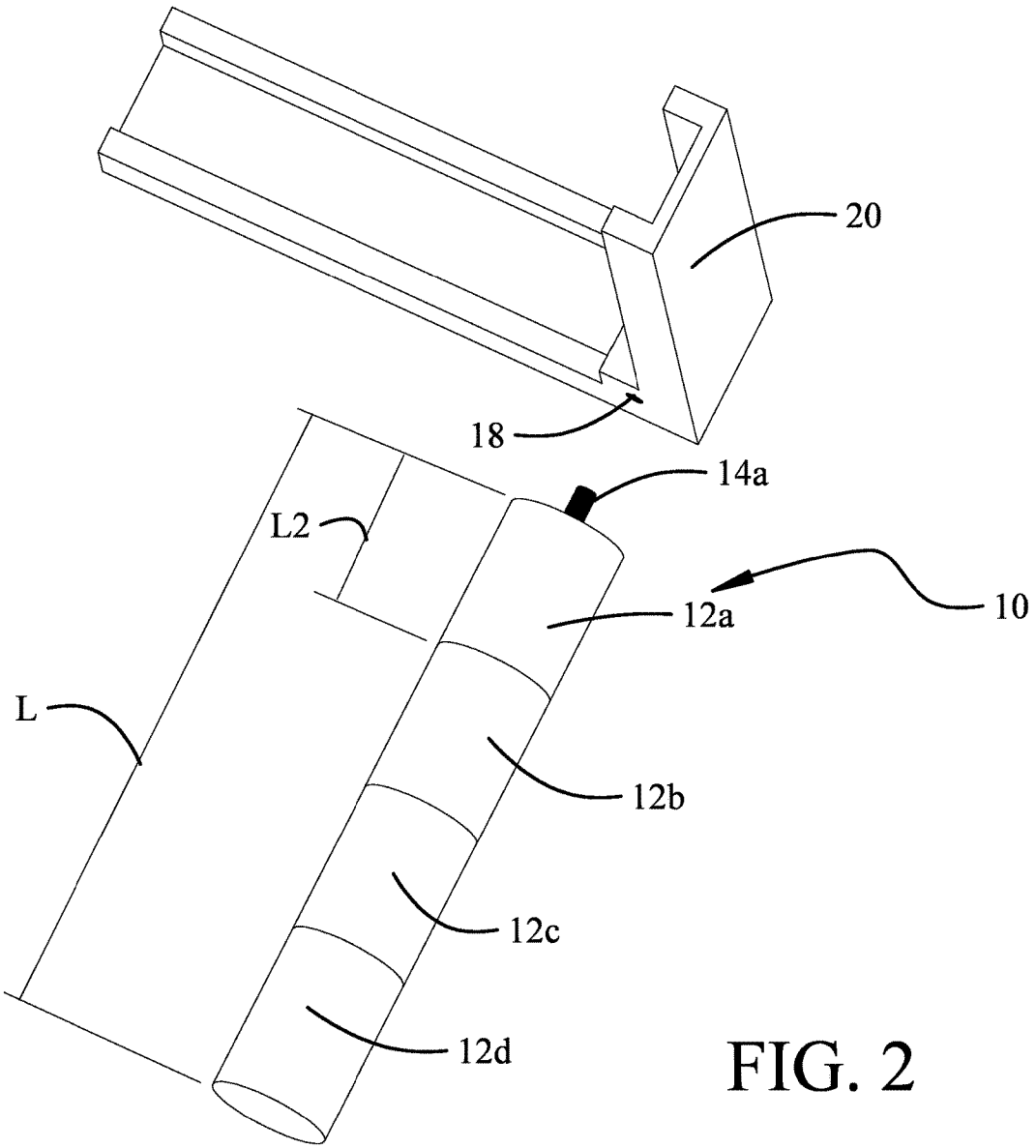
FIG. 2 is a pictorial depiction of the partial bedframe corner with the example segmented leg disassembled.
Figure 3:
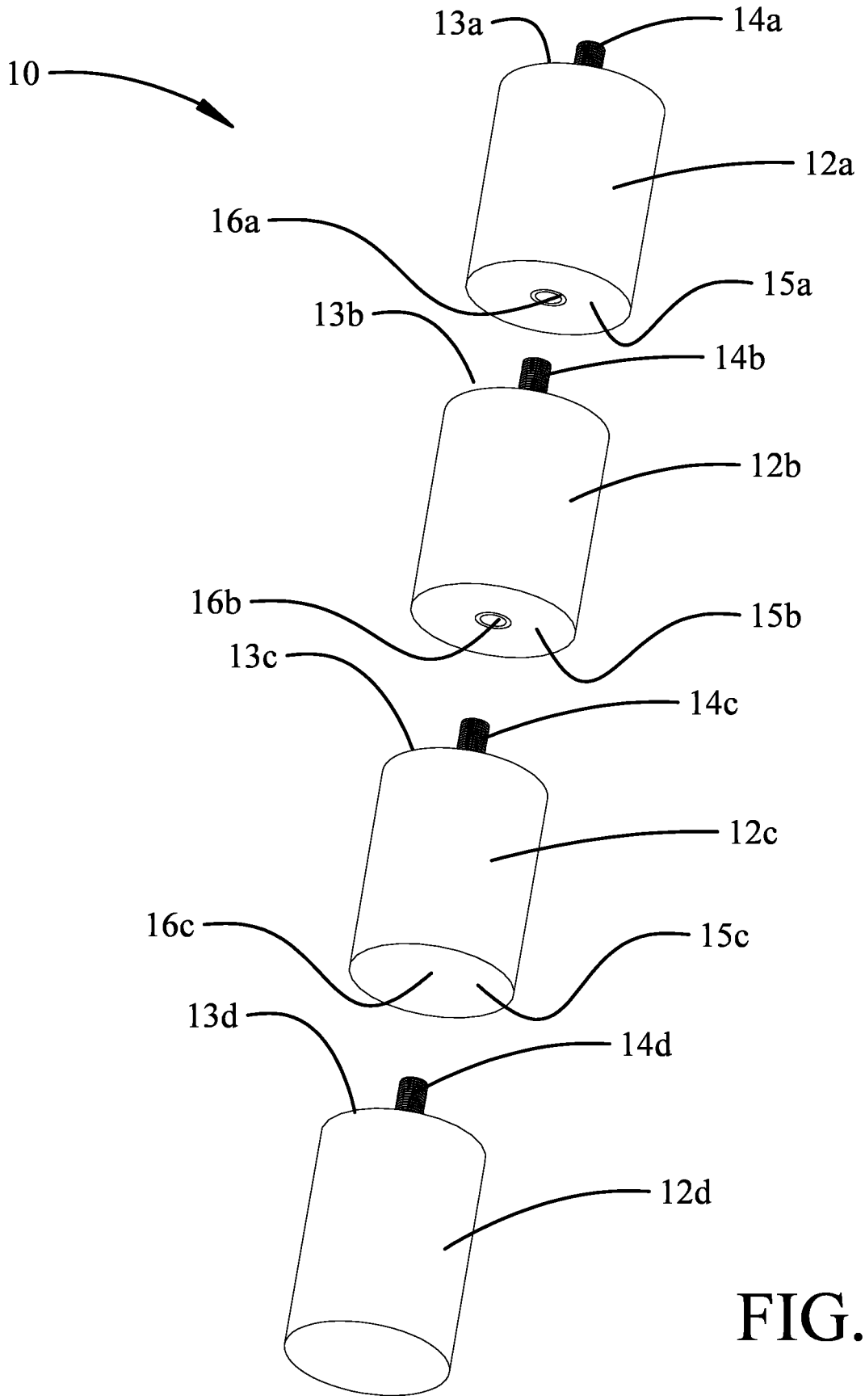
FIG. 3 is an exploded pictorial representation of the segmented leg sections.

Referring to the drawings, FIGS. 1-3 show an example segmented leg 10 with which the disclosed implementations may be employed. The segmented leg 10 incorporates segments 12*a*-12*d* which are separable to adjust a length L of the leg by increments of leg segment length L2. In the example shown, the segments 12*a*-12*d* are interconnected with threaded elements 14*a*-14*d* extending from upper surfaces 13*a*-13*d* received in mating bores 16*a*-16*c* on intermediate lower surfaces 15*a*-15*c* between the segments. The threaded element 14*a* of the top segment 12*a* is received in a threaded receiver 18 in a corner element of a bed frame 20.

Figure 4A:
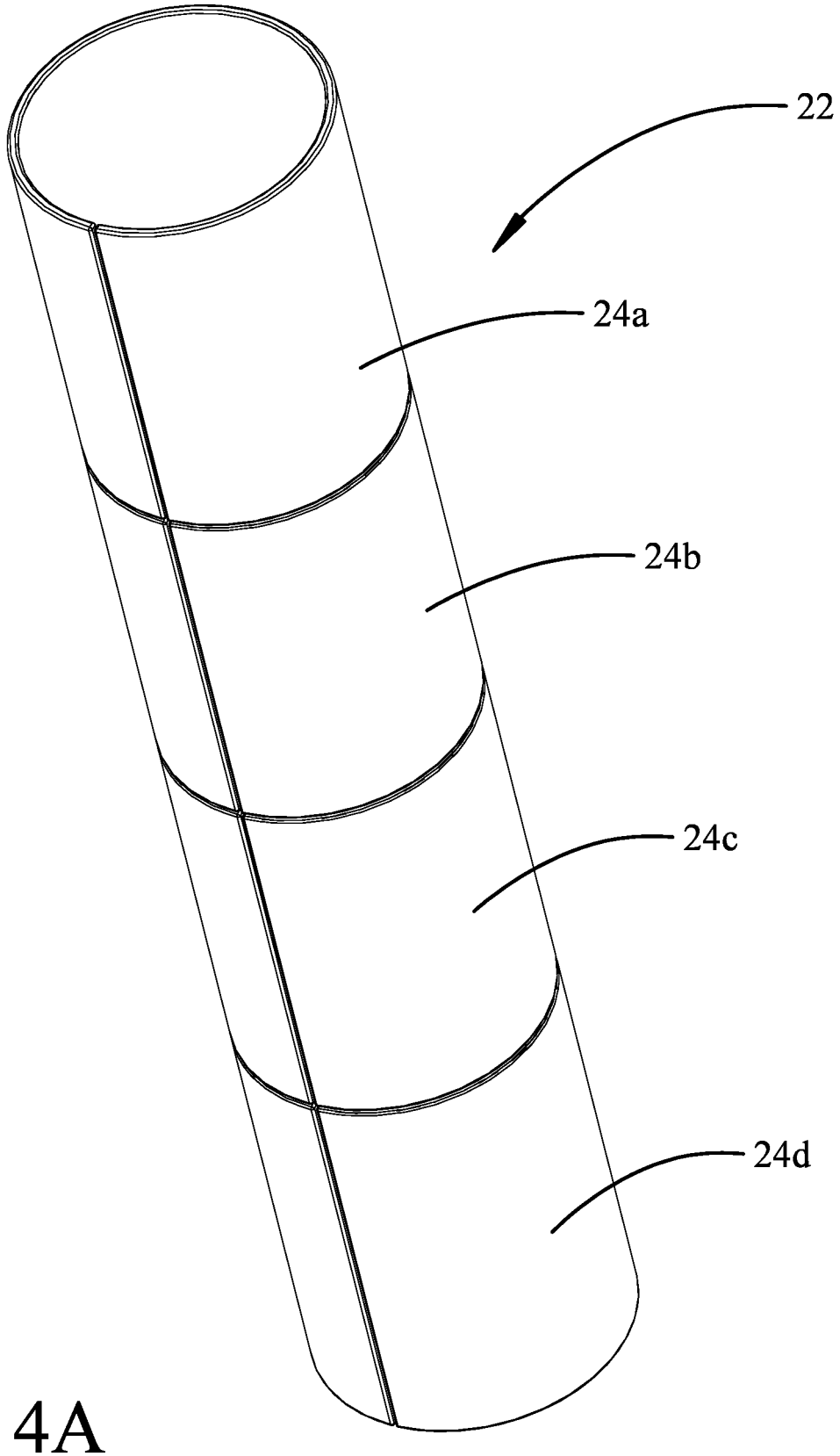
FIG. 4A is a pictorial representation of a first exemplary implementation of the adjustable length cover for a segmented bed leg.
Figure 4B:
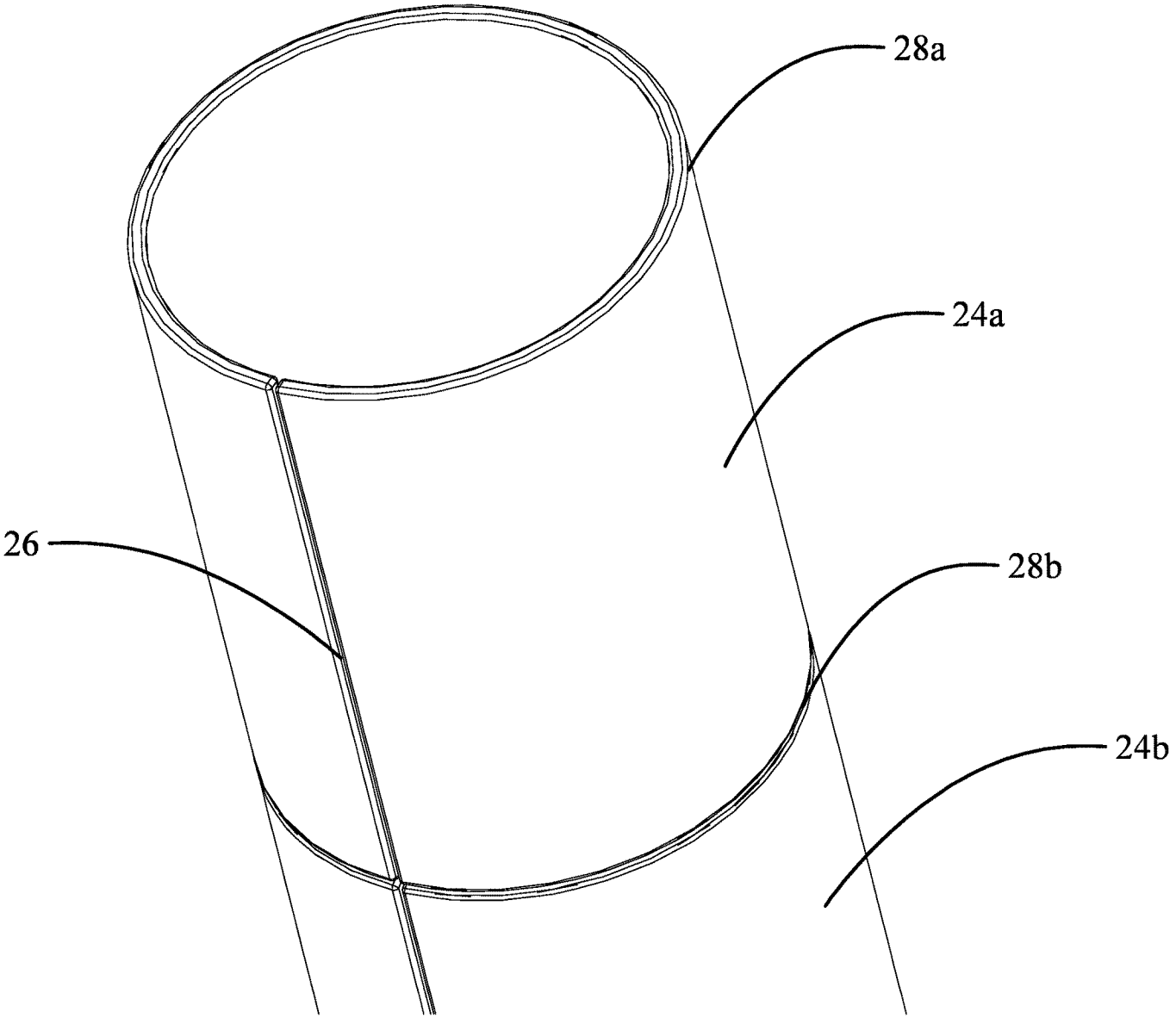
FIG. 4B is a detailed closeup of one section of the first exemplary implementation of the adjustable length cover.

A first example implementation of a segmented leg cover 22 is shown in FIGS. 4A and 4B. The leg cover 22 has a plurality of cover segments 24*a*-24*d* having matching length L3 with length L2 of the leg segments 12*a*-12*d* providing a total length matching leg length L. As seen in detail in FIG. 4B, each cover segment has a longitudinal separation 26, an upper circumferential separation 28*a* and a lower circumferential separation 28*b*. The segmented cover 22 is adapted to be separated at the circumferential separations to match a reduced length of the segmented leg if one or more leg segments is removed.

Figure 5:
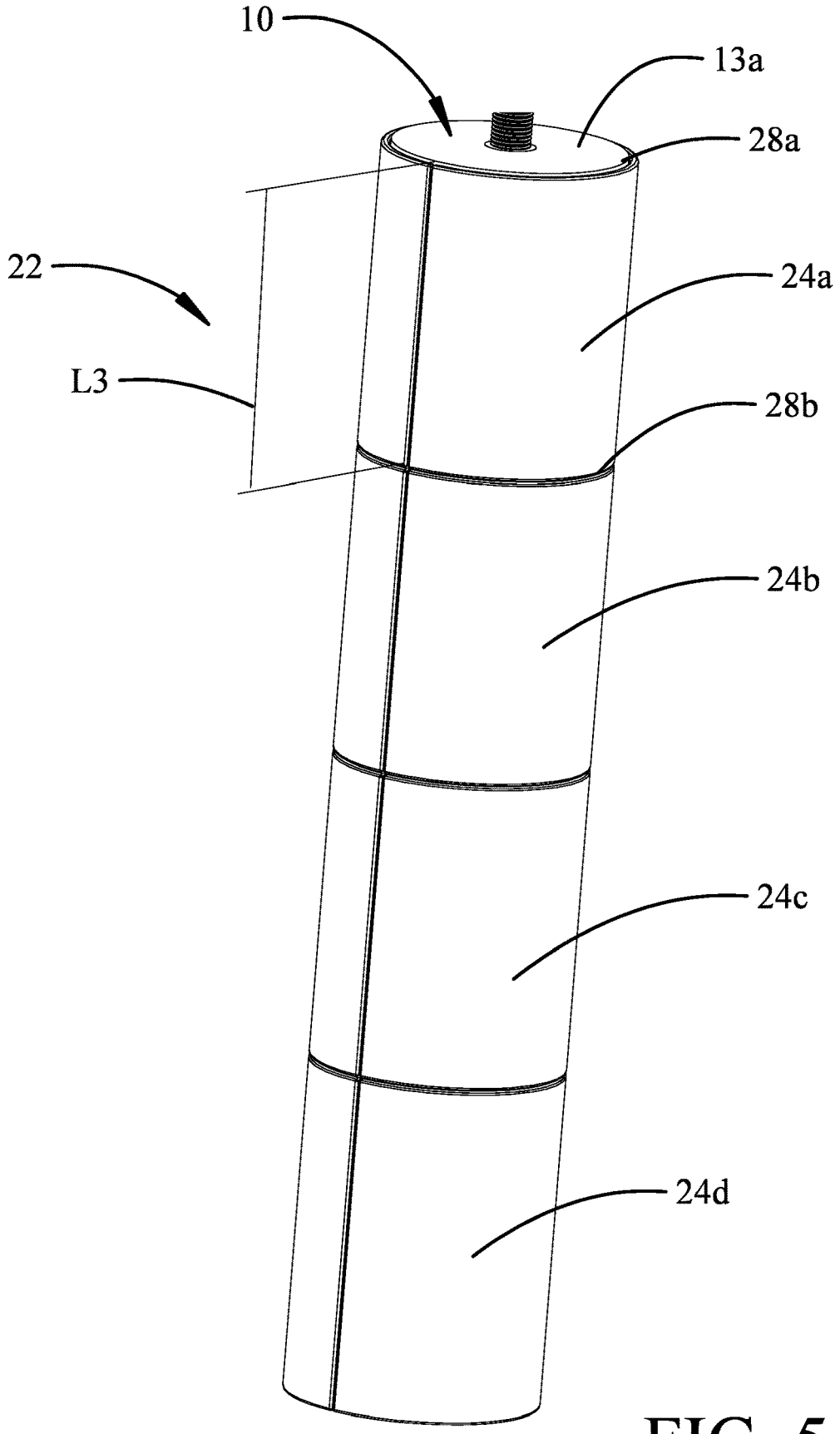
FIG. 5 is a pictorial representation of the first exemplary implementation of the adjustable length bed leg cover engaged to the segmented bed leg at full length.

As seen in FIG. 5, the segmented leg cover 22 is sized to be concentrically received over the segmented leg 10 with the upper circumferential separation 28*a* of the top cover segment 24*a* in planar alignment with a top surface 13*a* of the top leg segment 12*a*. Matching lengths L3 of the cover segments with the lengths L2 of the leg segments provides alignment of the upper and lower circumferential separations 28*a*, 28*b* in the segmented leg cover 22 with the upper and lower surfaces of the leg segments 12*a*-12*d*.

In various implementations, the longitudinal and circumferential separations may be perforated lines or reduced thickness cuts in the material of the cover segments leaving a thin connecting web whereby the segments are adapted to be disconnected from the adjacent segments at the circumferential separations and from the encircled leg segment at the longitudinal separation. The segmented leg cover 22 employs flexible material such as polyethylene or polypropylene allowing the individual cover segments to be "peeled" from the segmented leg fracturing the perforated lines or connecting webs to free the removed segment.

Figure 6:
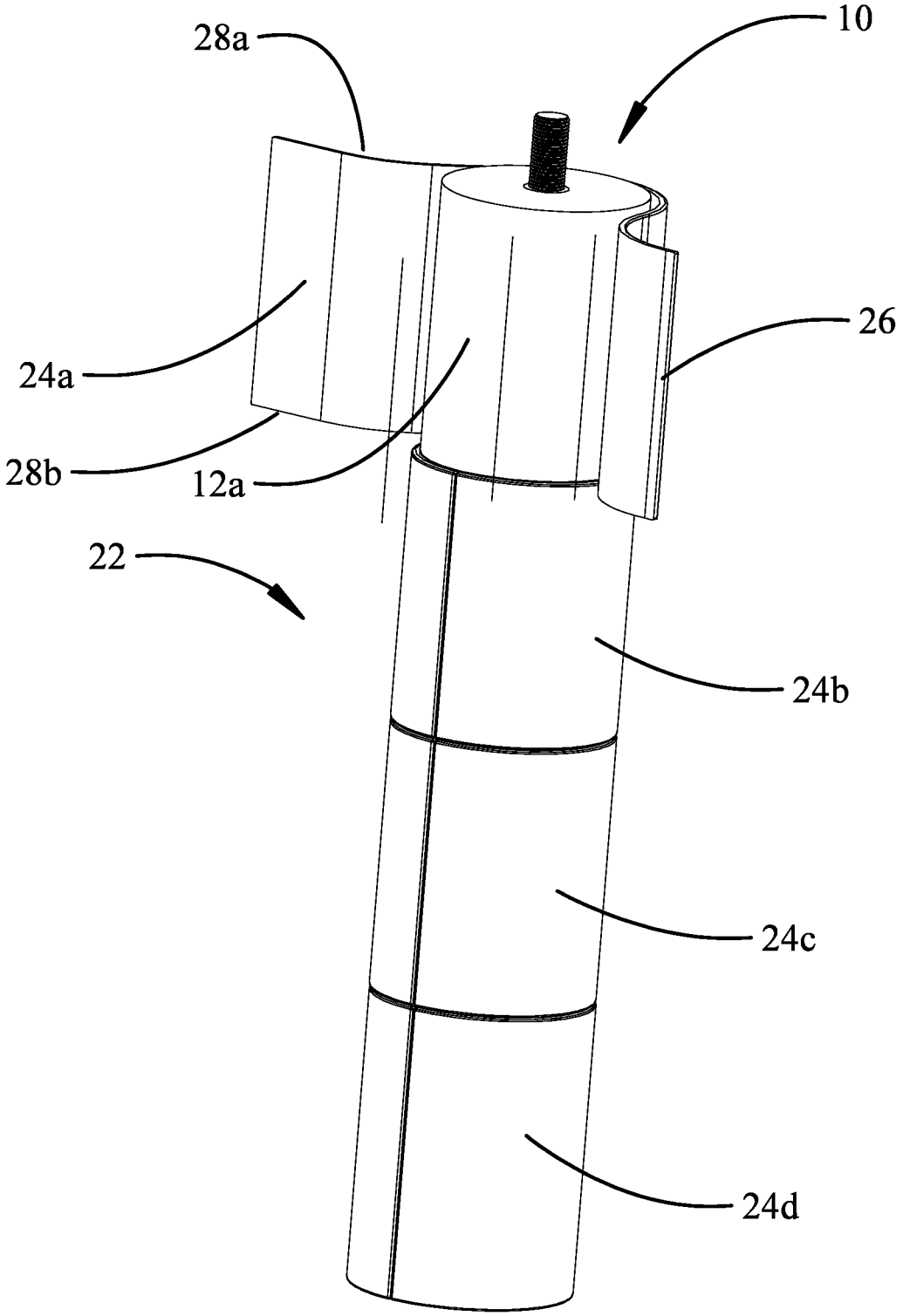
FIG. 6 is pictorial representation of a first exemplary implementation of the adjustable length bed leg cover being reduced in length by one segment.
Figure 7:
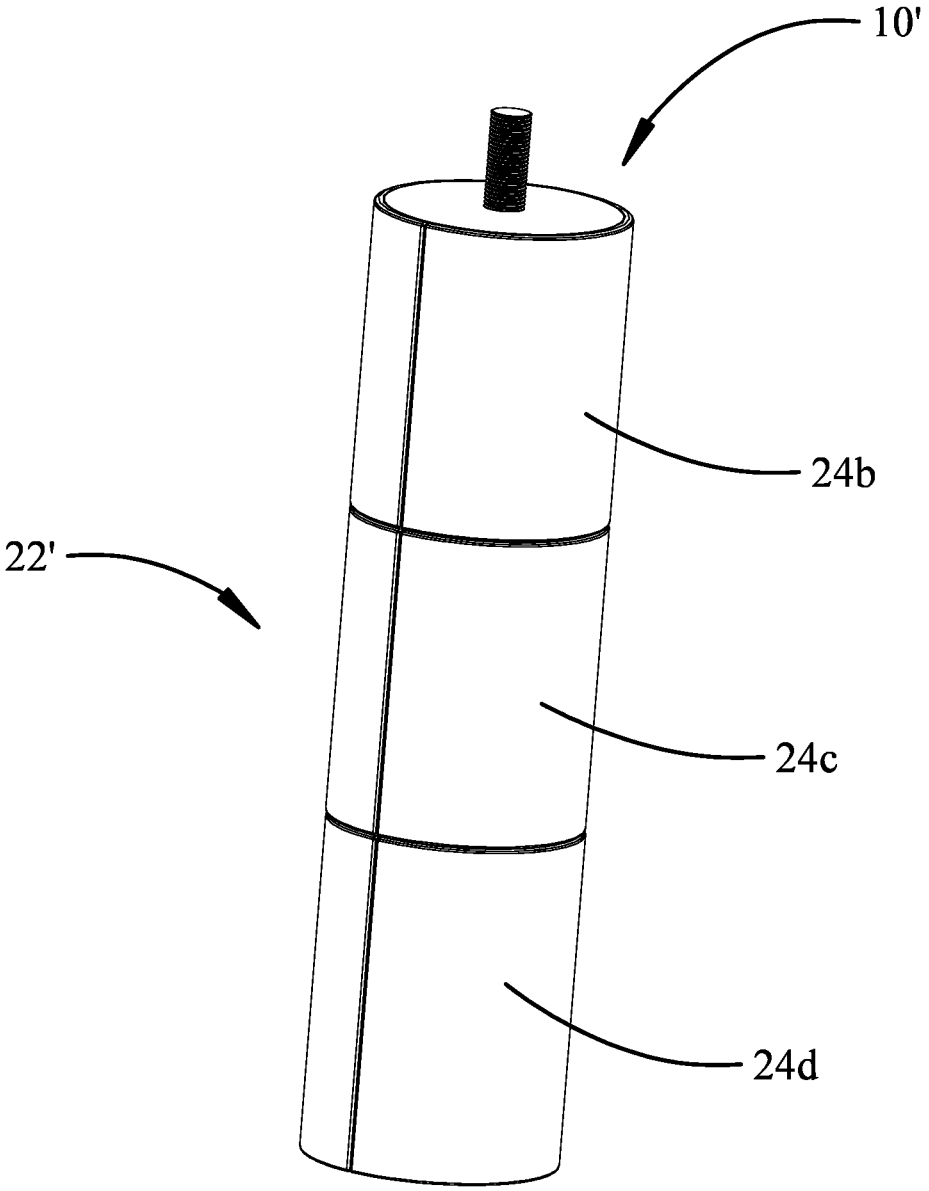
FIG. 7 is a pictorial representation of the first exemplary implementation of the adjustable length bed leg cover engaged to the segmented bed leg reduced in length by one segment.
Figure 8:
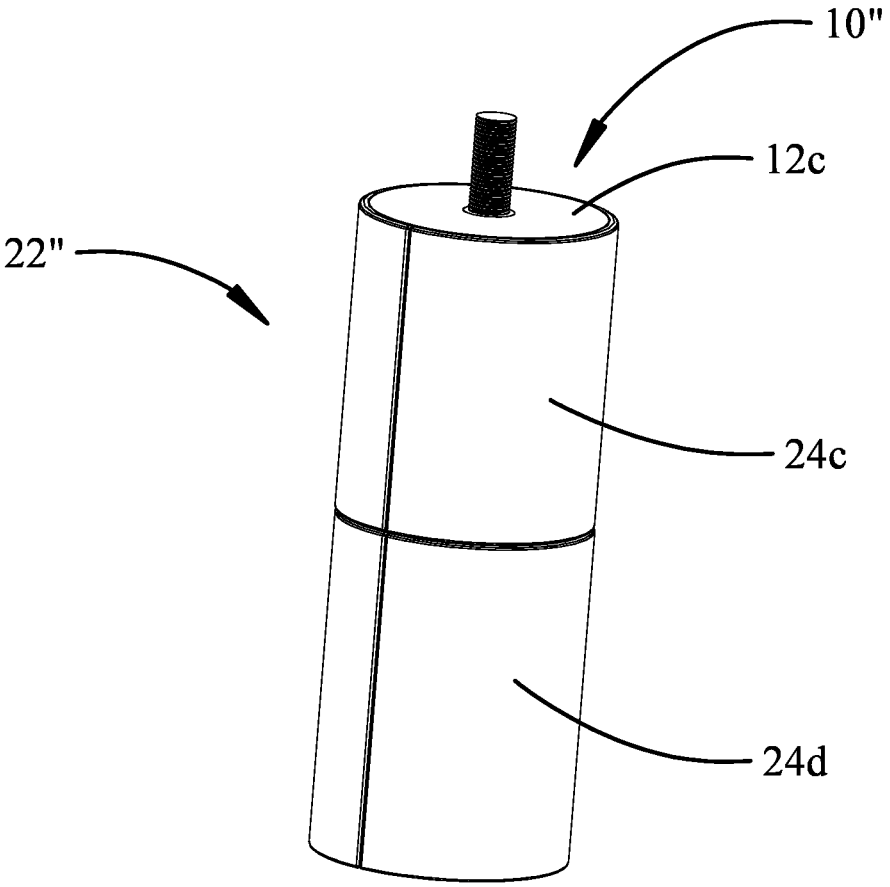
FIG. 8 is a pictorial representation of the first exemplary implementation of the adjustable length bed leg cover engaged to the segmented bed leg reduced in length by two segments.

FIG. 6 demonstrates removal of one cover segment 24*a* to allow reduction in length of the segmented leg 10 by one segment 12*a*. The reduce length leg 10' and reduced length segmented cover 22' is then shown in FIG. 7. FIG. 8 discloses a further reduced segmented leg 10" and segmented cover 22" reduced in length by two segments.

In certain configurations the segmented leg covers 22 are formed from magnetic sheet to allow magnetically attractive connection to segmented legs fabricated from metal.

Figure 9A:
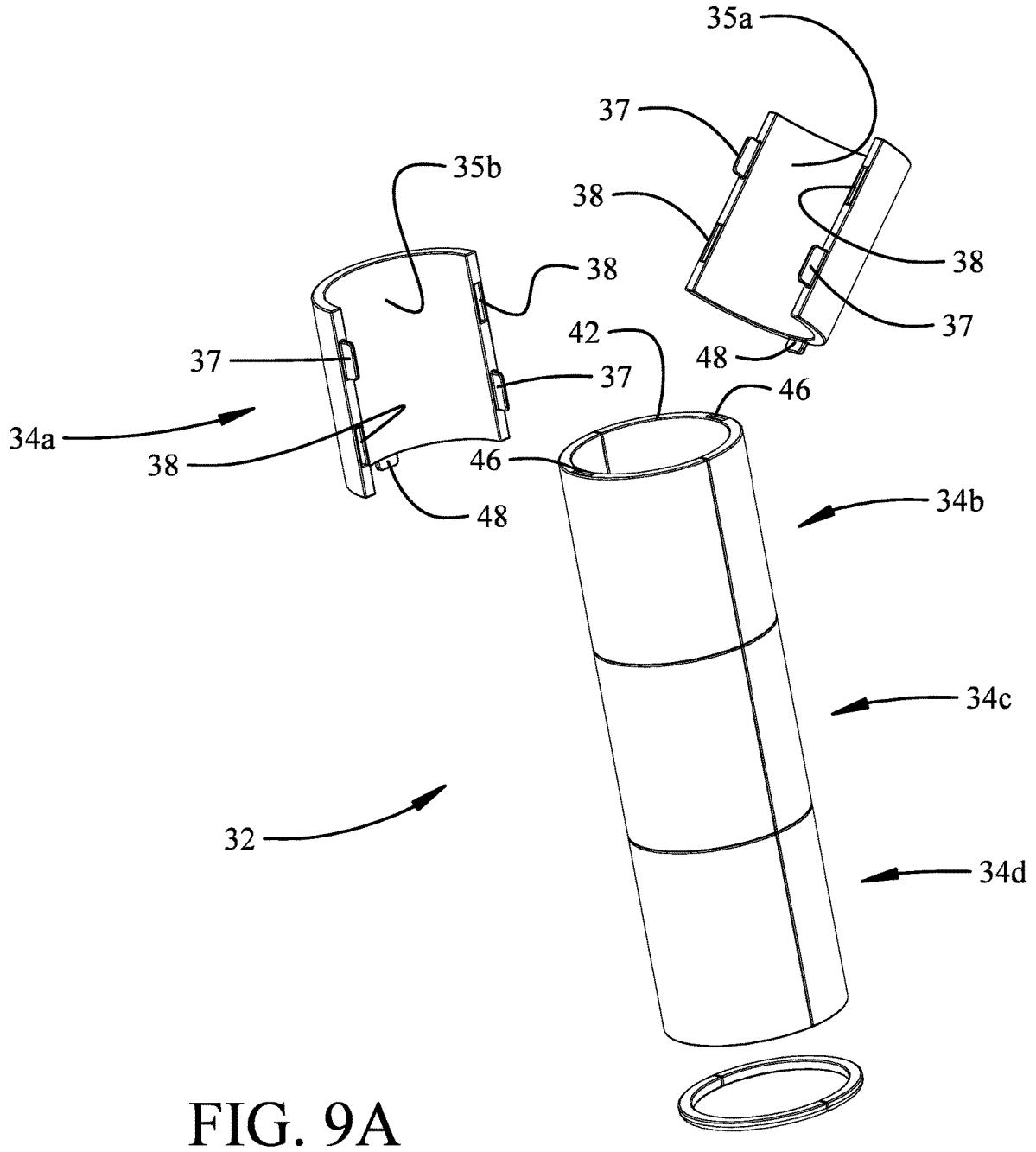
FIG. 9A is a pictorial representation of a second exemplary implementation of the adjustable length cover for a segmented bed leg.
Figure 9B:
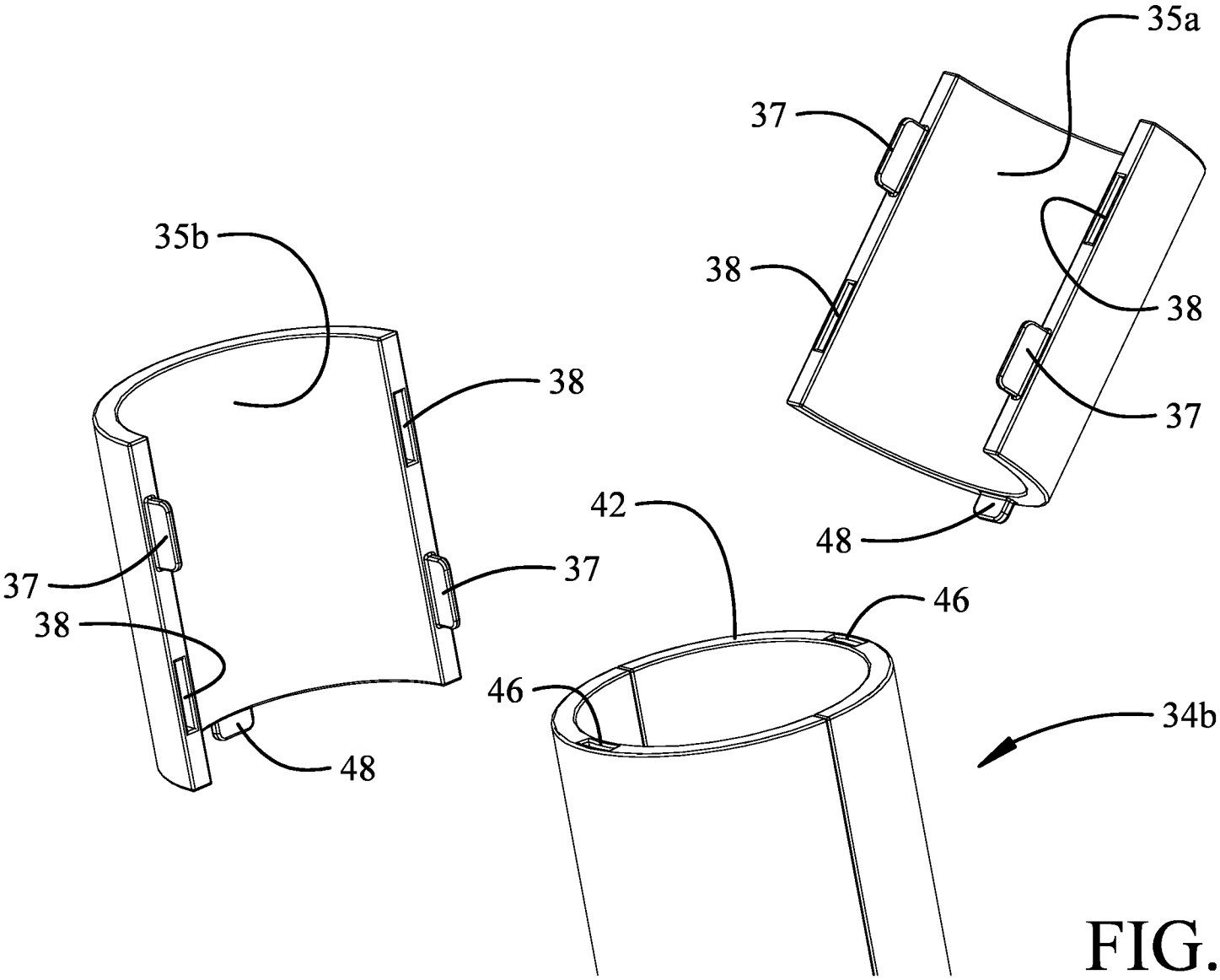
FIG. 9B is a detailed closeup of one section of the second exemplary implementation of the adjustable length cover disconnected from the cover.

FIGS. 9A and 9B show a second implementation of a segmented leg cover 32. A plurality of cover segments 34*a*-34*d* are molded bifurcated half cylindrical segments 35*a* and 35*b* joined at diametrically opposed longitudinal separations 36*a* and 36*b*. Each of the longitudinal separations includes at least one protrusion 37 which is received in a mating cavity or slot 38 in the opposing longitudinal separation on the opposing half cylindrical segment. The protrusions and slots may provide a frictional fit to retain the joined half cylindrical segments or may be barbed or have other known forms of "snap locking" features. A finish ring 39 may be employed on the bottom circumference 40*b* of the lowest cover segment 34*d* (and/or on the upper circumference 40*a* of the top cover segment as seen in FIG. 10 subsequently) to facilitate securing the bifurcated half cylindrical sections.

Each of the plurality of cover segments 34*a*-34*d* have upper circumferential surfaces 42 and lower circumferential surfaces 44 when the half cylindrical segments 35*a* and 35*b* are joined. Each upper circumferential surface has a vertical cavity or slot 46 which is sized to receive a vertical protrusion 47 in a lower circumferential surface 45 of the upwardly adjoining cover segment.

Figure 10:
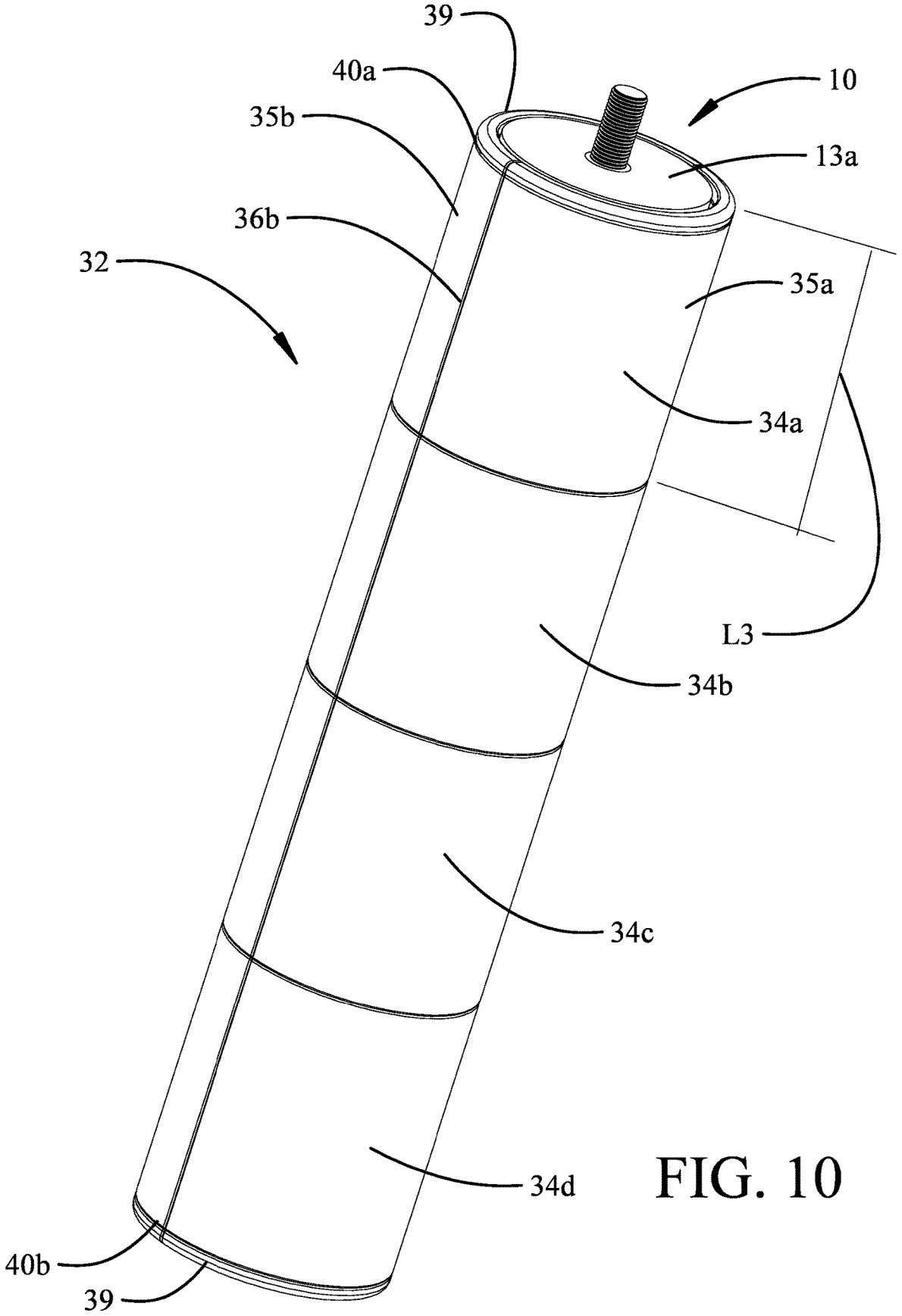
FIG. 10 is a pictorial representation of the second exemplary implementation of the adjustable length bed leg cover engaged to the segmented bed leg at full length.

As in the first implementation, the segmented leg cover 32 is concentrically received over the segments leg 10 as seen in FIG. 10. Also as in the first implementation, the upper circumferential surface 42 of the top cover segment 34*a* in substantial planar alignment with a top surface 13*a* of the top leg segment 12*a*. Matching lengths L3 of the cover segments 34*a*-34*d* with the lengths L2 of the leg segments provides alignment of the upper and lower circumferential surfaces 42 and 44 in the segmented leg cover 32 with the upper and lower surfaces of the leg segments 12*a*-12*d*.

Figure 11:
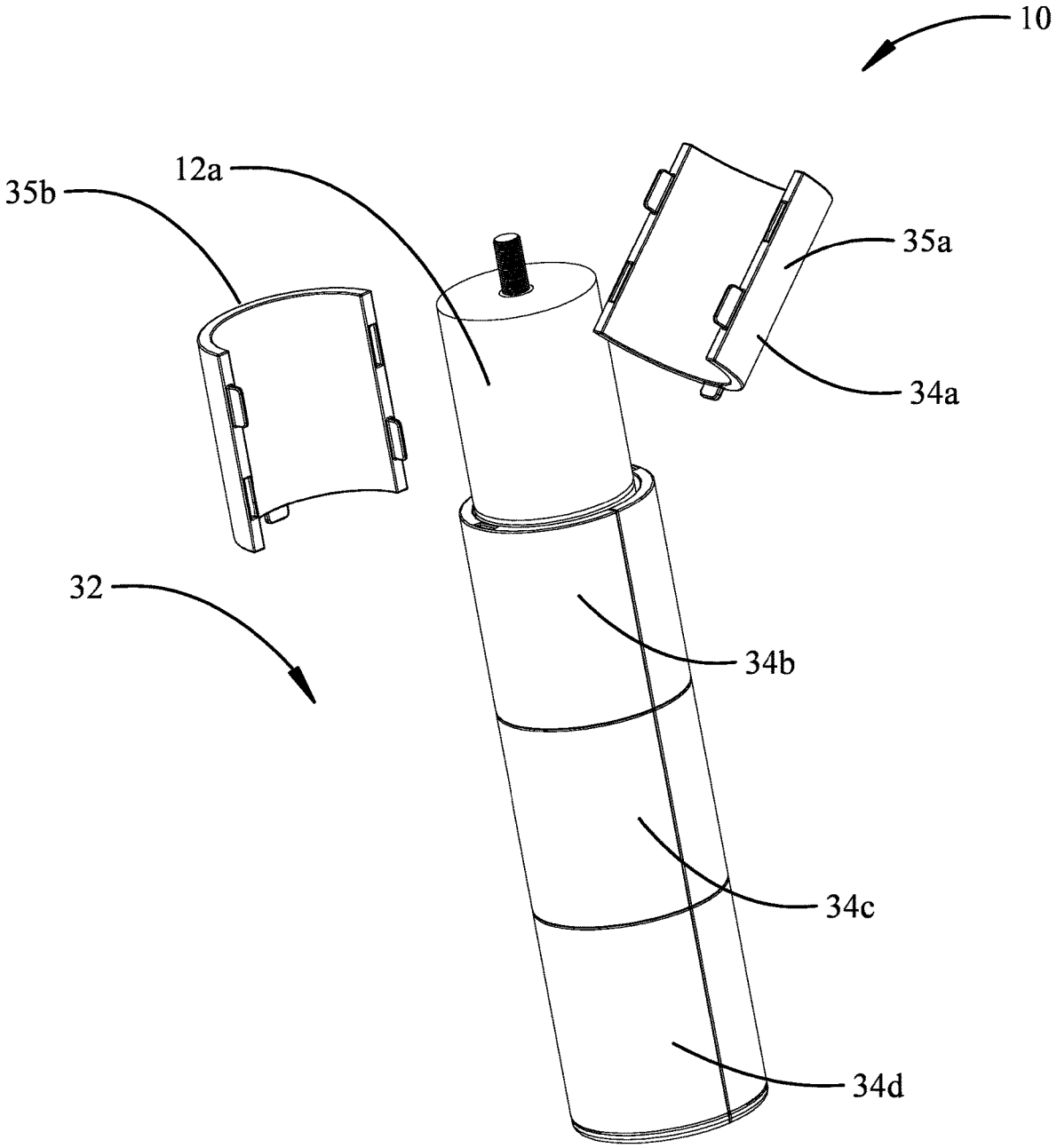
FIG. 11 is pictorial representation of a second exemplary implementation of the adjustable length bed leg cover being reduced in length by one segment.
Figure 12:
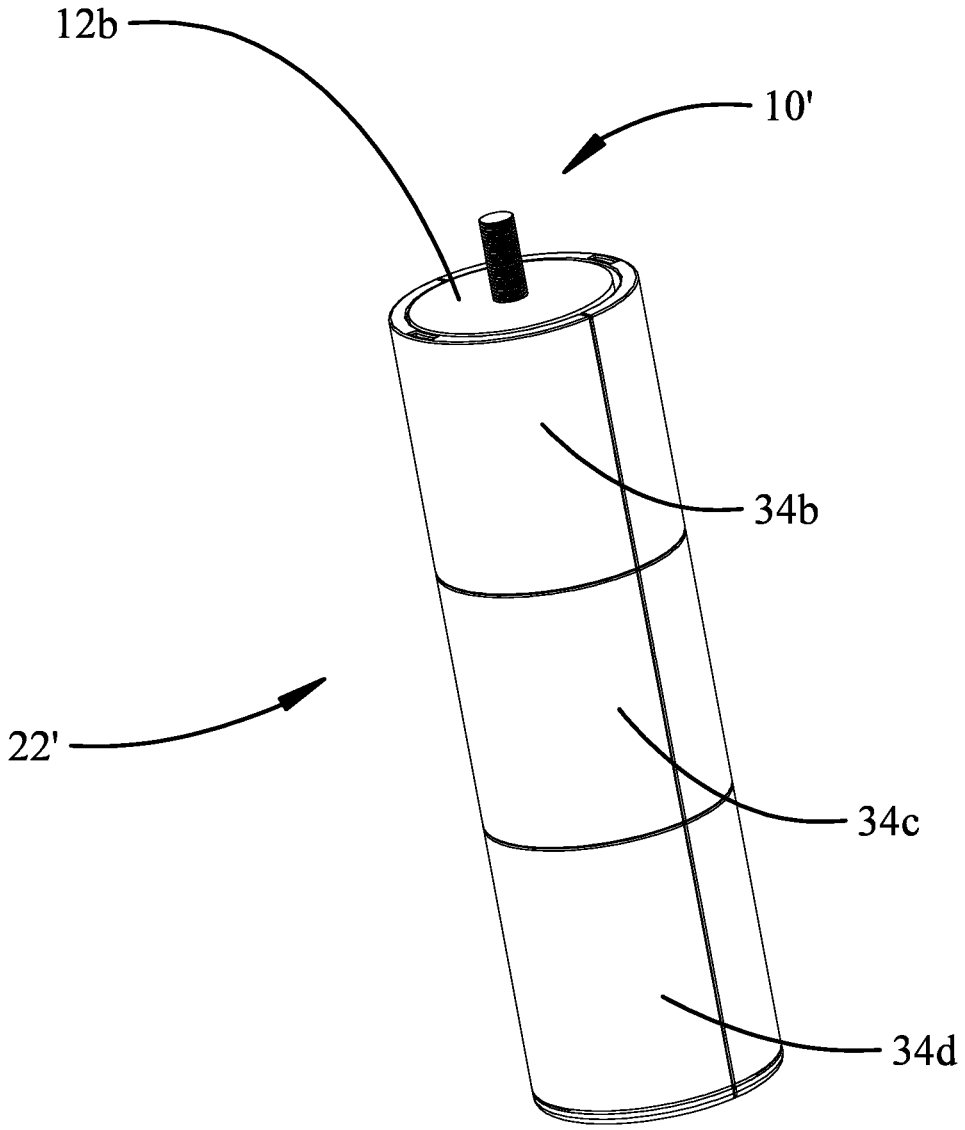
FIG. 12 is a pictorial representation of the second exemplary implementation of the adjustable length bed leg cover engaged to the segmented bed leg reduced in length by one segment.
Figure 13:
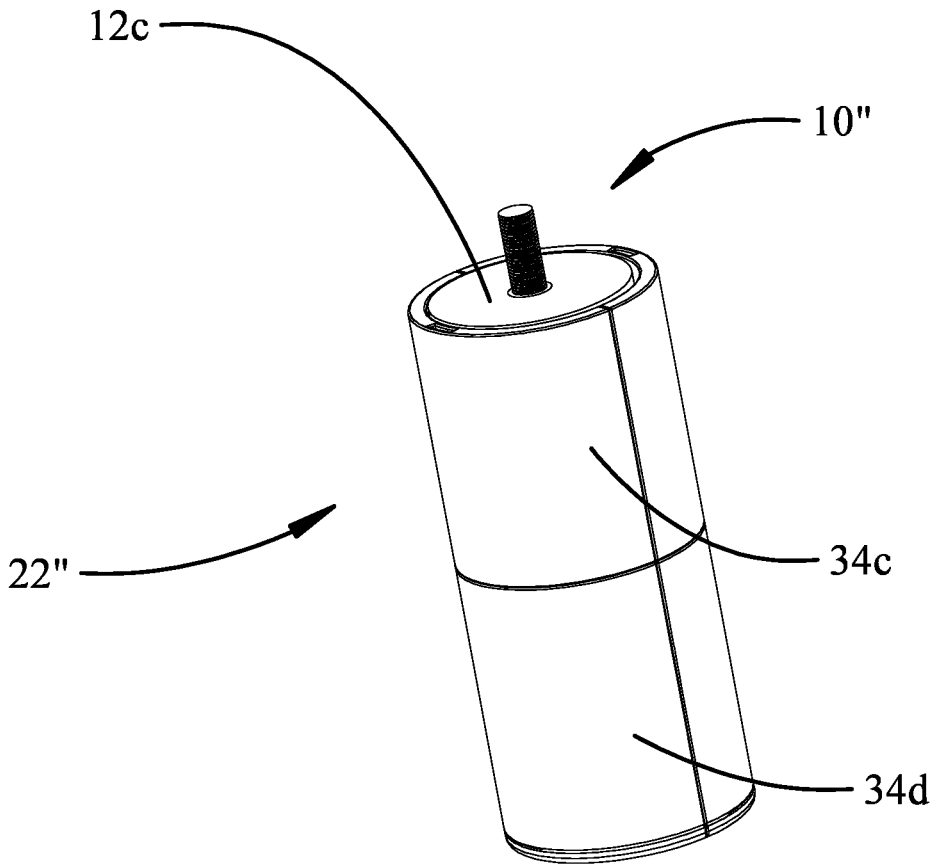
FIG. 13 a pictorial representation of the second exemplary implementation of the adjustable length bed leg cover engaged to the segmented bed leg reduced in length by two segments.

Removal of leg segments to reduce the length of the leg may be matched with removal of cover segments to provide equal length as seen in FIG. 11. The resulting leg length with one leg segment 12*a* and one cover segment 34*a* removed is shown in FIG. 12 and with two leg segments 12*a* and 12*b* and two cover segments 34*a* and 34*b* removed is shown in FIG. 13. While described herein as "removable" segments to match a leg length with removed leg segments, the cover segments may be assembled to match the number of leg segments in the desired leg length.

The segmented leg covers in each of the disclosed implementations are formed or printed in colors and/or patterns for the desired aesthetic appearance. Solid or mixed colors of various sheens (gloss, satin (semi-gloss) and matte) may be provided and patterns such as wood grain with walnut, mahogany, cherry or other fine wood coloring, or, stainless steel, chrome, or other metallic finish may be employed.

In operation, a method for use of the first implementation provides for insertion of the full segmented leg concentrically into the segmented cover, step 1. Upon determining that a reduced length of the leg is desired, the top cover segment is peeled from the top leg segment, fracturing the longitudinal separation and lower circumferential separation of the top cover segment, step 2. The top leg segment is then removed from the second leg segment by unscrewing the mating bore of the top leg segment from the threaded element of the second bore step 3. The reduced length leg and cover may then be attached to the frame with the threaded element extending from the second leg segment step 4. To further shorten the leg, steps 2-3 may be repeated for any desired number of leg segment reductions.

For the second implementation, as in the first implementation, the segmented cover may be concentrically received over the segmented leg, step 1 and upon determining that a reduced length of the leg is desired, the top cover segment is separated from the second cover segment by withdrawing the vertical protrusions of the top cover segment from the vertical slots in the top circumferential surface of the second cover segment and then splitting the half cylindrical segments by withdrawing the protrusions from the slots to separate the half cylindrical segments of the top cover segment from the top leg segment, step 2. The top leg segment is then removed from the second leg segment by unscrewing the mating bore of the top leg segment from the threaded element of the second bore step 3. The reduced length leg and cover may then be attached to the frame with the threaded element extending from the second leg segment step 4. To further shorten the leg, steps 2-3 may be repeated for any desired number of leg segment reductions. Alternatively, the segmented cover may be installed on a shortened leg by removing the number of undesired cover segments and then closing the remaining cover segments concentrically about the leg by inserting the protrusions of the half cylindrical segments on the remaining cover segments into the slots on the opposing half cylindrical segments.

Having now described various embodiments of the invention in detail as required by the patent statutes, those skilled in the art will recognize modifications and substitutions to the specific embodiments disclosed herein. Such modifications are within the scope and intent of the present invention as defined in the following claims. The terms "upper" and "lower", "upwardly", "top", and "bottom" as used herein are not limiting and specific to the depiction of the implementations shown in the drawings and may be replaced with alternative terms "first", "second" or similar differentiations depending on the actual implementation.

What is claimed is:

1. A leg cover of a system having a bed leg having a plurality of leg segments and the leg cover, the cover comprising:

a plurality of cover segments each having a matching length with a length of a corresponding one of the leg segments, each cover segment having a longitudinal separation, an upper circumferential separation and a lower circumferential separation, wherein the leg cover is concentrically received over the bed leg and is adapted to be separated at the circumferential separations to match a reduced length of the segmented leg if one or more leg segments is removed;

wherein the upper and lower circumferential separations of each of the cover segments in the segmented leg cover are in planar alignment with upper and lower surfaces of one of the one leg segment corresponding thereto.

2. The leg cover as defined in claim 1 wherein the leg cover is sized to be concentrically received over the segmented leg with the upper circumferential separation of a top one of the plurality of cover segment in planar alignment with a top surface of a top leg segment of the plurality of leg segments wherein matching lengths L3 of each of the plurality of cover segments with the lengths L2 of the plurality of leg segments provides that the upper and lower circumferential separations in the segmented leg cover are in the planar alignment with the upper and lower surfaces of the leg segments.

3. The leg cover as defined in claim 2 wherein the longitudinal and circumferential separations are perforated lines whereby each cover segment is adapted to be disconnected from an adjacent cover segments at the circumferential separation and from the leg segment encircled by the cover segment at the longitudinal separation.

4. The leg cover as defined in claim 2 wherein the longitudinal and circumferential separations are reduced thickness cuts in the material of the cover segments leaving a thin connecting web whereby each cover segment is adapted to be disconnected from an adjacent cover segments at the circumferential separation and from the leg segment encircled by the cover segment at the longitudinal separation.

5. The leg cover as defined in claim 2 wherein the plurality of cover segments each comprise molded bifurcated half cylindrical segments joined at diametrically opposed longitudinal separations.

6. The leg cover as defined in claim 5 wherein each of the longitudinal separations includes at least one protrusion which is received in a mating cavity or slot in an opposing longitudinal separation on an opposing half cylindrical segment.

7. The leg cover as defined in claim 6 wherein the protrusions and slots engage with a frictional fit to retain the joined half cylindrical segments.

8. The leg cover as defined in claim 6 further comprising a finish ring engaged on the bottom circumference of a lowest of the plurality of cover segments.

9. The leg cover as defined in claim 6 wherein each of the plurality of cover segments have an upper circumferential surface and lower circumferential surface when the half cylindrical segments are joined and each upper circumferential surface has a vertical cavity or slot which is sized to receive a vertical protrusion in a lower circumferential surface of an upwardly adjoining cover segment of the plurality of cover segments.

10. The leg cover as defined in claim 1, wherein each of the cover segments is removable from the one leg segment corresponding thereto.

11. The leg cover as defined in claim 1, wherein the leg cover extends around the leg with an inner surface of the cover contacting an outer surface of the leg.

12. The leg cover as defined in claim 11, wherein each cover segment extends around the one leg segment corresponding thereto, and each cover segment forms the inner surface of the cover and each of the leg segments forms the outer surface of the leg.

13. A system comprising:

a bed leg having a plurality of leg segments that are removable from each other to adjust a length of the bed leg, each having an upper surface and a lower surface;

a cover over the bed leg and having a plurality of cover segments, each cover segment corresponding to one of the leg segments and having an upper circumferential end and a lower circumferential end that are aligned, respectively, with the upper surface and the lower surface of the one leg segment corresponding thereto.

14. The system as defined in claim 13, wherein at least two of the cover segments are adjacent to each other and include an upper cover segment and a lower cover segment with the lower circumferential end of the upper cover segment being adjacent the upper circumferential end of the lower cover segment.

15. The system as defined in claim 14, wherein the upper cover segment and the lower cover segment are separably coupled to each other by a separation formed at the lower circumferential end of the upper cover segment and the upper circumferential end of the lower cover segment.

16. A leg cover for a bed leg having a plurality of leg segments, the cover comprising:

a plurality of cover segments each having a matching length with a length of a corresponding one of the leg segments, each cover segment having a longitudinal separation, an upper circumferential separation and a lower circumferential separation, wherein the leg cover is concentrically received over the bed leg and is adapted to be separated at the circumferential separations to match a reduced length of the segmented leg if one or more leg segments is removed;

wherein the plurality of cover segments each comprise molded bifurcated half cylindrical segments joined at diametrically opposed longitudinal separations.

17. The leg cover as defined in claim 16 wherein each of the longitudinal separations includes at least one protrusion which is received in a mating cavity or slot in an opposing longitudinal separation on an opposing half cylindrical segment.

18. The leg cover as defined in claim 17 wherein the protrusions and slots engage with a frictional fit to retain the joined half cylindrical segments.

19. The leg cover as defined in claim 17 further comprising a finish ring engaged on the bottom circumference of a lowest of the plurality of cover segments.

20. The leg cover as defined in claim 17 wherein each of the plurality of cover segments have an upper circumferential surface and lower circumferential surface when the half cylindrical segments are joined and each upper circumferential surface has a vertical cavity or slot which is sized to receive a vertical protrusion in a lower circumferential surface of an upwardly adjoining cover segment of the plurality of cover segments.

* * * * *